US006477324B1

(12) United States Patent
Sun

(10) Patent No.: US 6,477,324 B1
(45) Date of Patent: Nov. 5, 2002

(54) SHOWER HEATING DEVICE

(76) Inventor: Ming-Hsin Sun, 5F, No. 16, Lane 12, Shih-Chieh St., Chu-Tung Town, Hsin-Chu Hsien (TW)

( * ) Notice: Subject to any disclaimer, the term of this patent is extended or adjusted under 35 U.S.C. 154(b) by 0 days.

(21) Appl. No.: 09/855,876

(22) Filed: May 14, 2001

(51) Int. Cl.[7] ..... F24H 1/10

(52) U.S. Cl. ..... 392/482; 392/480; 4/598; 165/172

(58) Field of Search ..... 392/465, 467, 392/479, 480, 482; 4/598; 165/172, 177

(56) References Cited

U.S. PATENT DOCUMENTS 4,678,112 A * 7/1987 Koisuka et al. ..... 165/173
5,054,549 A * 10/1991 Nakaguro ..... 165/133
5,101,887 A * 4/1992 Kado ..... 165/173
5,101,890 A * 4/1992 Aoki et al. ..... 165/152
5,438,642 A * 8/1995 Posen ..... 122/19.1
5,995,711 A * 11/1999 Fukuoka et al. ..... 219/202
6,166,351 A * 12/2000 Yamamoto ..... 219/202

* cited by examiner

*Primary Examiner*—Teresa Walberg
*Assistant Examiner*—Thor Campbell
(74) *Attorney, Agent, or Firm*—Pro-Techtor International Services

(57) ABSTRACT

A shower heating device has an undulated tube, a plurality of semiconductor heating elements securely received in the undulated tube, a plurality of pairs of electrical plates each being provided to have one of the semiconductor heating elements sandwiched therebetween and a plurality of pairs of insulation plates each having one of the pairs of the electrical plates received therebetween. With such an arrangement, the water in the undulated tube is able to be heated shortly.

1 Claim, 5 Drawing Sheets

SHOWER HEATING DEVICE

BACKGROUND OF THE INVENTION

1. Field of the Invention

The present invention relates to a shower heating device, and more particularly to a shower heating device mounted in an undulated tube and having a plurality of semiconductor heating elements, a plurality of pairs of electrical plates each being provided to have one of the semiconductor heating elements sandwiched therebetween and a plurality of pairs of insulation plates each having one of the pairs of the electrical plates received therebetween. With such an arrangement, the water in the undulated tube is able to be heated shortly.

2. Prior Art Description

Users need to heat up the water so as to shower in cold days. Due to the variety of regions, there are different ways of heating the water, such as using the natural gas, burning the wood or coal and using the electricity to generate the heat so as to rise the temperature of the water. Patents disclosing the similar structure are already available in the market, however the efficiency of heating the water is still not satisfactory to the user. To improve the unsatisfied efficiency of the heating to the water for shower, the present invention intends to provide an improved heating device for shower, which is able to heat the water more efficient in an effective manner.

The present invention provides an improved heating device for shower to overcome the above mentioned shortcomings.

SUMMARY OF THE INVENTION

The primary objective of the invention is to provide an improved shower heating device mounted in an undulated tube and having a plurality of semiconductor heating elements, a plurality of pairs of electrical plates each being provided to have one of the semiconductor heating elements sandwiched therebetween and a plurality of pairs of insulation plates each having one of the pairs of the electrical plates received therebetween. With such an arrangement, the water in the undulated tube is able to be heated shortly.

Another objective of the invention is to provide a converging area in the inlet and the outlet of the undulated tube so as to increase the eddy effect of water to maintain the temperature of the heated water in an even state.

Other objectives, advantages and novel feature of the invention will become more apparent from the following detailed description when taken in conjunction with the accompanying drawings.

DETAILED DESCRIPTION OF PREFERRED EMBODIMENT

Figure 1:
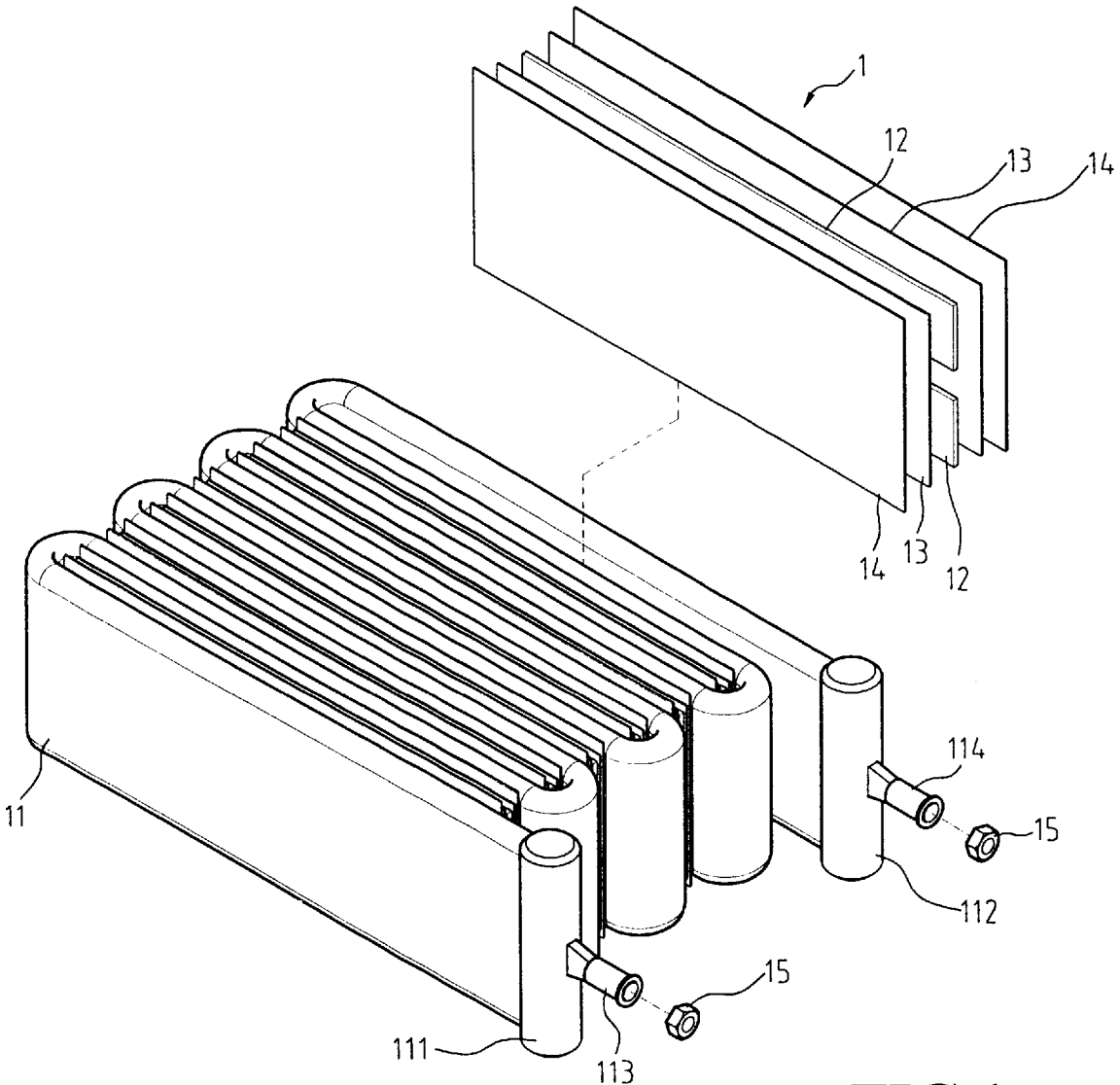
FIG. 1 is an exploded perspective view showing the shower heating device constructed in accordance with the present invention.

With reference to FIG. 1, a shower heating device 1 constructed in accordance with the present invention has an undulated tube (11), a plurality of semiconductor heating elements (12), a plurality of pairs of electrical plates (13) each pair being provided to have one of the semiconductor heating elements (12) sandwiched therebetween and a plurality of pairs of insulation plates (14) each pair having one of the pairs of the electrical plates (13) received therebetween. The undulated tube (11) is able to increase the heating time to the water in that within the limited area, the water has to travel more distance due to the undulated pattern of the tube (11). A first converging area (111) is mounted at the joint between the undulated tube (11) and an inlet (113) of the undulated tube (11). The first converging area (111) is a tube-like area and is in vertical direction to the water inlet direction, such that an eddy effect will occur to fully agitate the water flowing into the undulated tube (11). A second converging area (112) is mounted at the joint between the undulated tube (11) and an outlet (114) of the undulated tube (11). The second converging area (112) is a tube-like area and in vertical direction to the water flowing out of the undulated tube (11), such that an eddy effect will occur to fully agitate the heated water flowing out of the tube (11) so as that the water temperature is even. A nut (15) is provided to the inlet (113) and the outlet (114), such that the shower heating device (1) is able to connect with a normal hose (not shown).

Figure 2:
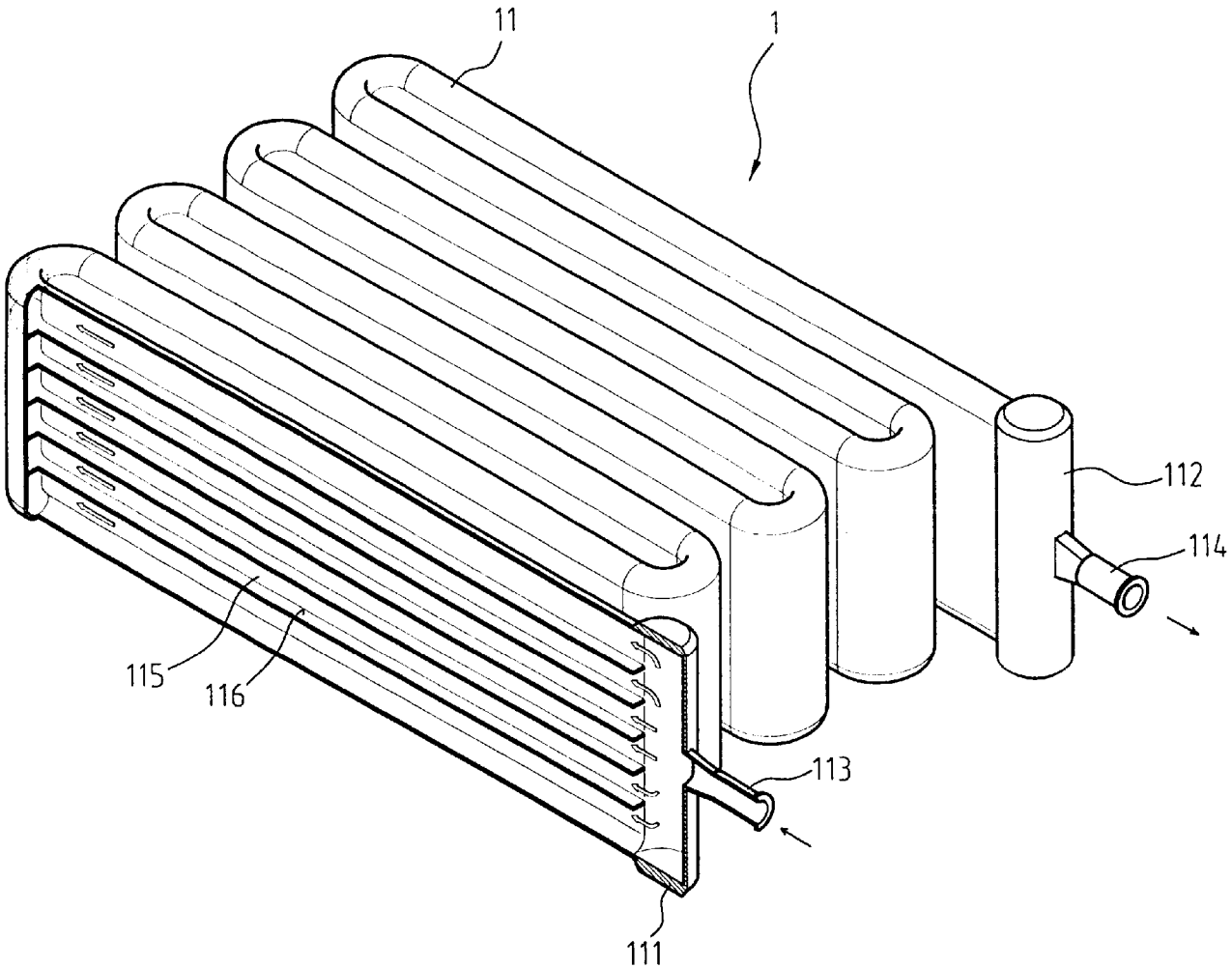
FIG. 2 shows the perspective undulated tube in partial cross section.
Figure 3:
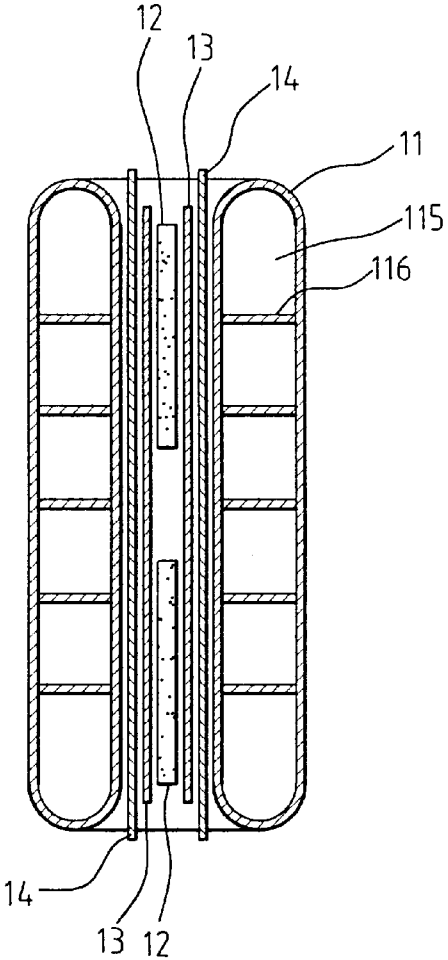
FIG. 3 is a sectional view of the undulated tube.

Referring to FIG. 2, it is noted that the undulated tube (11) is divided into multiple paths (115) by baffles (116) made of heat conductive material. It is noted from FIG. 3 that the semiconductor heating element (12) is sandwiched between two electrical plates (13) and an insulation plate (14) is provided outside the electrical plate (13).

When cold water is flowing into the undulated tube (11) via the first converging area (111), due to the eddy effect, the water is able evenly distributed into each one of the paths (115) to be heated by the semiconductor heating element (12). After the water is effectively and efficiently heated within the undulated tube (11), hot water will have to flow through the second converging area (112) to ensure the water temperature is even and then to the outlet (114).

Figure 4:
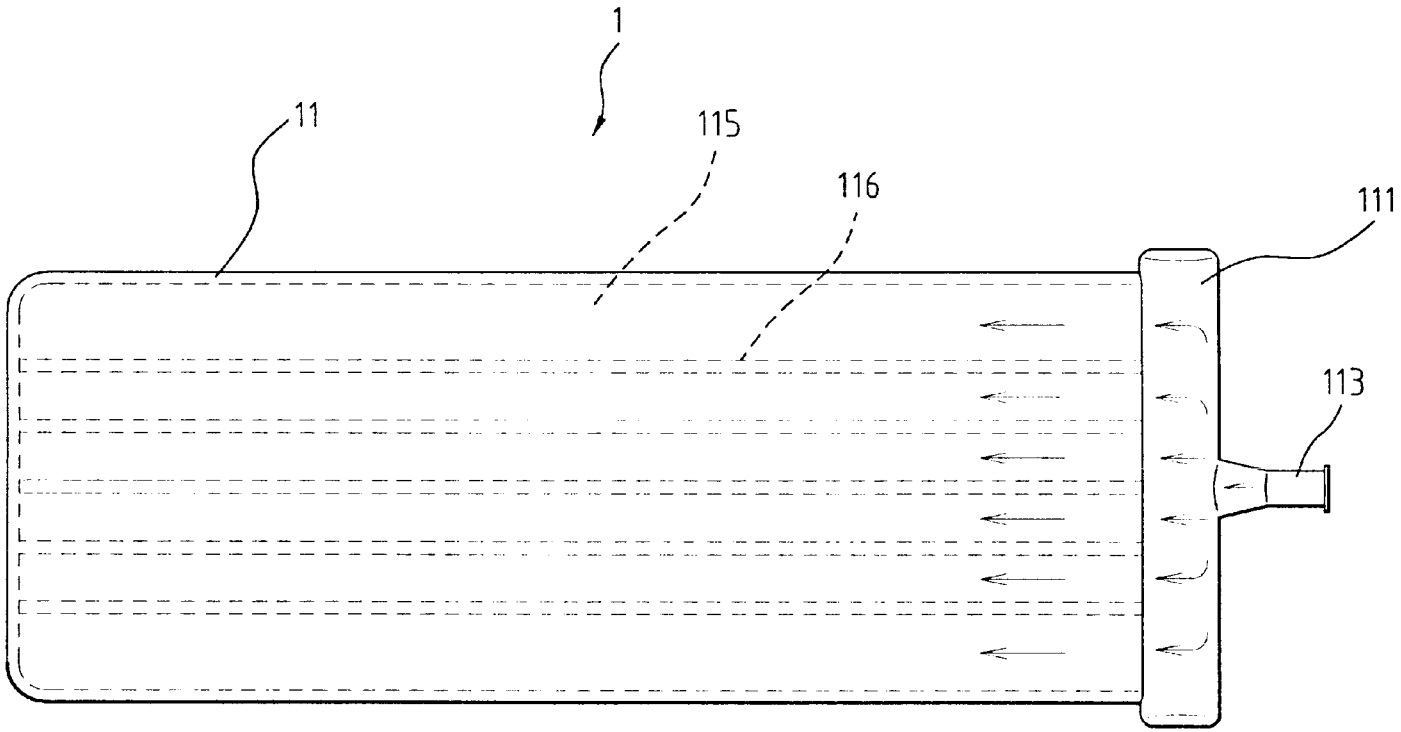
FIG. 4 is a top plan view of the undulated tube showing the movement of water in the tube.
Figure 5:
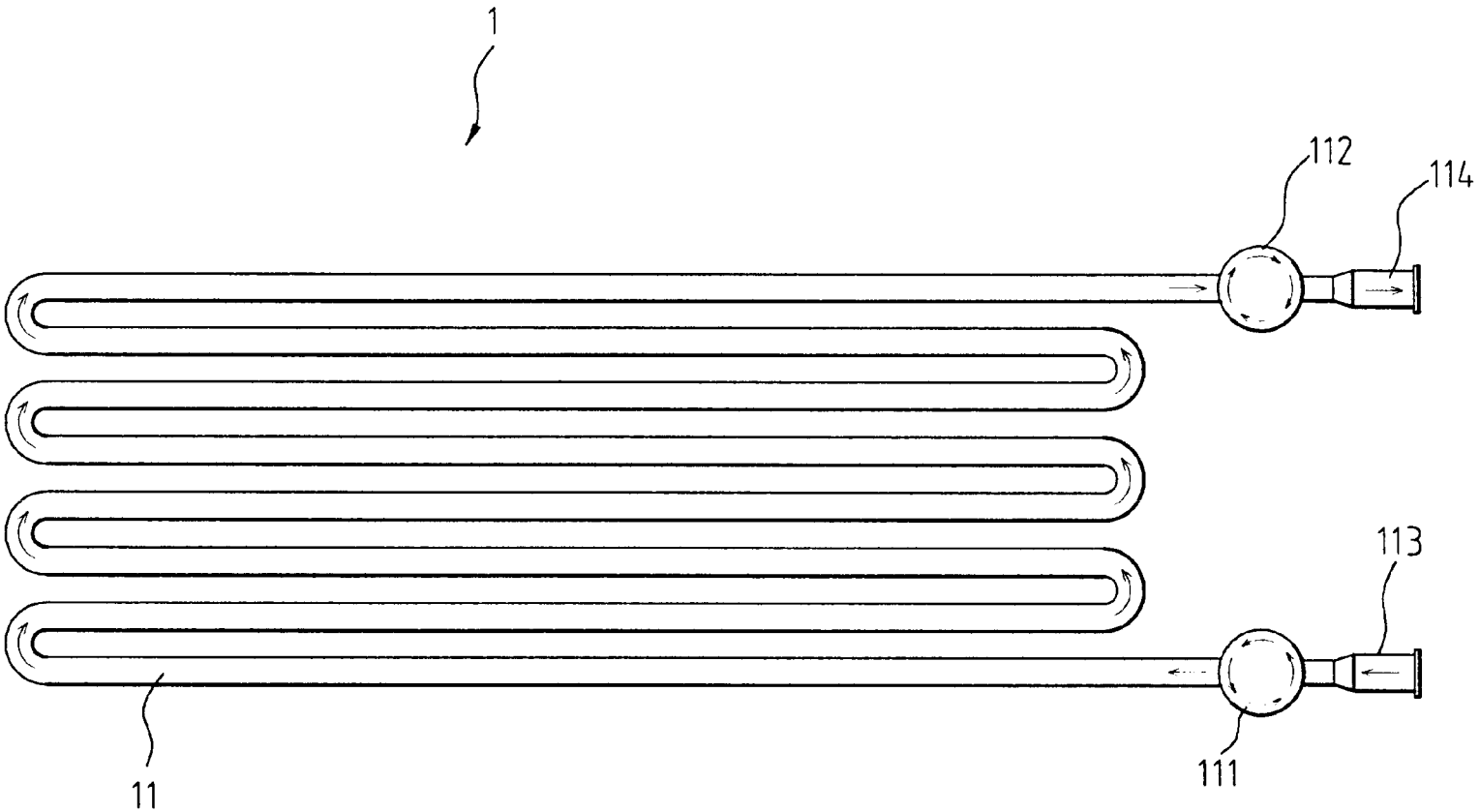
FIG. 5 is a side view of the shower heating device.

With reference to FIGS. 4 and 5, the water is able to be evenly distributed to each one of the paths (115) and the heated water is able to flow out of the undulated tube (11) via the outlet (114) in even temperature. Because of the provision of the second converging area (112), the undulated tube (11) constructed in accordance with the present invention is free from the occurrence of jet stream. With such an arrangement, the water is able to be heated by the semiconductor heating element (12) in the undulated tube (11) effectively and efficiently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shower heating device comprising:

a tube folded upon itself multiple times and having multiple water paths defined by baffles made of heat conductive material therein, an inlet, and an outlet;

a first converging area provided at a joint between said tube and said inlet to cause an eddy effect to water flowing into said tube, said first converging area is a tube-like area and is oriented in a direction perpendicular to said inlet and perpendicular to a direction of flow of the water in said tube, said inlet being located at a longitudinal midpoint of said first converging area;

a second converging area provided at a joint between said tube and said outlet to cause an eddy effect to heated water flowing out of said tube, said second converging area is a tube-like area and is oriented in a direction perpendicular to said inlet and perpendicular to a direction of flow of the heated water flowing out of said tube;

a plurality of semiconductor heating elements each being positioned adjacent to one of said paths to heat the water;

a plurality of pairs of electrical plates, each said pair of electrical plates having one of said semiconductor heating elements sandwiched therebetween;

a plurality of pairs of insulation plates, each said pair of insulation plates having one of said pairs of electrical plates received therebetween; and a nut provided on both said inlet and said outlet so as to allow said inlet and said outlet to be connected to a hose.

* * * * *